US008387380B2

(12) United States Patent
Roychoudhury et al.

(10) Patent No.: US 8,387,380 B2
(45) **Date of Patent: *Mar. 5, 2013**

(54) CATALYTIC BURNER APPARATUS FOR STIRLING ENGINE

(75) Inventors: Subir Roychoudhury, Madison, CT (US); David Spence, Beacon Falls, CT (US); Bruce B. Crowder, North Haven, CT (US); Richard T. Mastanduno, Milford, CT (US); Jonathan Berry, Simsonville, SC (US)

(73) Assignee: Precision Combustion, Inc., North Haven, CT (US)

( * ) Notice: Subject to any disclaimer, the term of this patent is extended or adjusted under 35 U.S.C. 154(b) by 818 days.

This patent is subject to a terminal disclaimer.

(21) Appl. No.: 12/587,593

(22) Filed: Oct. 8, 2009

(65) Prior Publication Data

US 2010/0126165 A1 May 27, 2010

Related U.S. Application Data

(63) Continuation-in-part of application No. 11/803,464, filed on May 14, 2007, now Pat. No. 7,913,484, which is a continuation-in-part of application No. 11/364,402, filed on Feb. 28, 2006, now abandoned.

(60) Provisional application No. 60/799,857, filed on May 13, 2006.

(51) Int. Cl.
*F01B 29/10* (2006.01)

(52) U.S. Cl. ..... 60/524; 60/517

(58) Field of Classification Search ..... 60/39.6, 60/517–526

See application file for complete search history.

(56) References Cited

U.S. PATENT DOCUMENTS

| | | | | |
|---|---|---|---|---|
| 4,255,121 | A | 3/1981 | Sugimoto | |
| 4,354,352 | A * | 10/1982 | Hoke et al. | 60/517 |
| 4,702,903 | A | 10/1987 | Keefer | |
| 4,965,052 | A | 10/1990 | Lowther | |
| 5,051,241 | A | 9/1991 | Pfefferle | |
| 5,590,526 | A | 1/1997 | Cho | |
| 5,725,151 | A | 3/1998 | Hetrick | |
| 5,918,463 | A | 7/1999 | Penswick | |
| 6,183,241 | B1 | 2/2001 | Bohn | |
| 6,282,895 | B1 | 9/2001 | Johansson | |
| 6,491,236 | B1 | 12/2002 | Keller | |
| 6,513,326 | B1 | 2/2003 | Maceda | |
| 6,746,657 | B2 | 6/2004 | Castaldi | |
| 6,755,021 | B2 | 6/2004 | Johansson | |
| 6,767,518 | B2 | 7/2004 | Ichikawa | |
| 6,775,982 | B1 | 8/2004 | Kitamura | |
| 6,857,260 | B2 | 2/2005 | Langenfeld | |
| 6,877,315 | B2 | 4/2005 | Clark | |
| 6,910,331 | B2 * | 6/2005 | Asai et al. | 60/517 |

(Continued)

FOREIGN PATENT DOCUMENTS

WO WO 2008048353 A2 4/2008

OTHER PUBLICATIONS

Co-pending U.S. Appl. No. 12/655,703, filed Jan. 6, 2010, in the names of Subir Roychoudhury, et al.; unpublished.

(Continued)

*Primary Examiner* — Hoang Nguyen
(74) *Attorney, Agent, or Firm* — Robert L. Rispoli

(57) ABSTRACT

The invention provides an apparatus and a method for transferring heat by conduction to the internal heat acceptor of an external combustion engine. Fuel and air are introduced into a combustion chamber and mixed to form an air/fuel mixture. The air/fuel mixture is directed into a catalytic reactor that is positioned in direct contact (non-spaced-apart relation) with the heater head. Heat is transferred via conduction from the catalytic reactor to the heater head; and the catalytic reaction products are exhausted with heat recuperation.

15 Claims, 9 Drawing Sheets

U.S. PATENT DOCUMENTS

| | | | | |
|---|---|---|---|---|
| 6,931,848 | B2 | 8/2005 | Maceda | |
| 7,913,484 | B2 * | 3/2011 | Roychoudhury et al. | 60/39.6 |
| 2004/0209205 | A1 | 10/2004 | Gomez | |
| 2005/0028445 | A1 | 2/2005 | Roychoudhury | |
| 2007/0151154 | A1 | 7/2007 | Lyubovsky | |
| 2008/0078175 | A1 | 4/2008 | Roychoudhury | |
| 2008/0127553 | A1 | 6/2008 | Roychoudhury | |
| 2009/0113889 | A1 | 5/2009 | Roychoudhury | |

OTHER PUBLICATIONS

Co-pending U.S. Appl. No. 12/655,702, filed Jan. 6, 2010, in the names of Subir Roychoudhury, et al.; unpublished.

* cited by examiner

FIG. 1
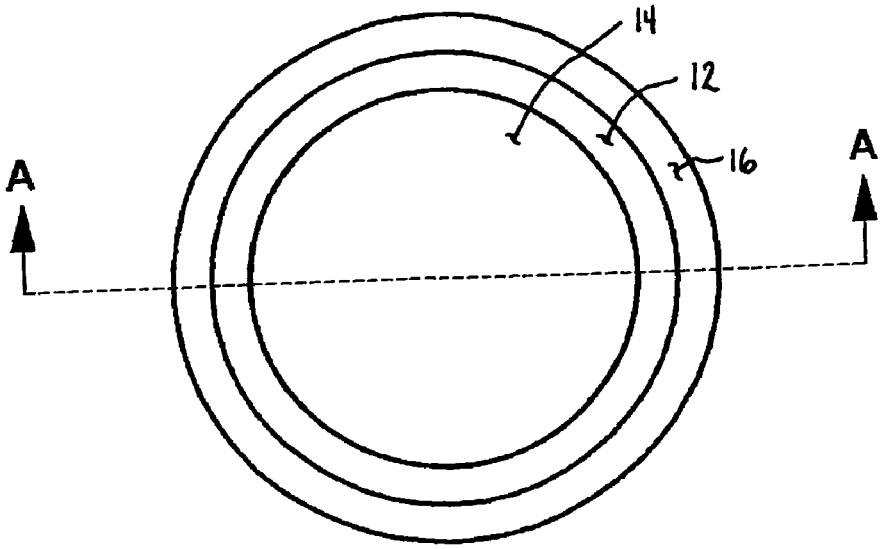
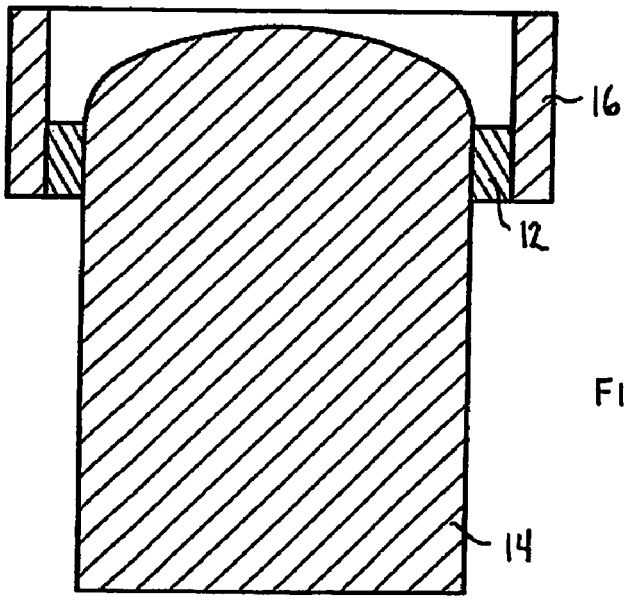
FIG. 2
SECTION A-A

CATALYTIC BURNER APPARATUS FOR STIRLING ENGINE

CROSS-REFERENCE

This application is a continuation-in-part of U.S. patent application Ser. No. 11/803,464, filed May 14, 2007 now U.S. Pat. No. 7,913,484, which claims the benefit of U.S. Provisional Application No. 60/799,857, filed May 13, 2006. This application is a continuation-in-part of U.S. patent application Ser. No. 11/803,464, filed May 14, 2007, which is also a continuation-in-part of U.S. patent application Ser. No. 11/364,402, filed Feb. 28, 2006 now abandoned. The aforementioned priority applications are incorporated herein in their entirety by reference.

GOVERNMENT RIGHTS

This invention was made with government support under U.S. Contract No. W911-NF-04-1-0238, Subaward No. Y-04-0023. The U.S. government holds certain rights in this invention.

FIELD OF THE INVENTION

The present invention is generally directed to an apparatus for providing heat to an external combustion engine. In particular, the present invention is directed toward providing substantially conductive heat transfer to an internal heat acceptor, commonly referred to as a heater head, of the external combustion engine, preferably, a Stirling Engine. More particularly, the present invention comprises a burner containing a recuperator, fuel injector, mixer (via swirler), igniter for catalyst ignition (for example, via resistive heating), and in a preferred embodiment, a heat transfer arrangement (heat exchanger).

BACKGROUND OF THE INVENTION

As is well known in the art, Stirling Engines convert a temperature difference directly into movement. Such movement, in turn, can be used as mechanical energy or converted into electrical energy. The Stirling Engine cycle comprises the repeated heating and cooling of a sealed amount of working gas. When the gas in the sealed chamber is heated, the pressure increases and acts on a piston thereby generating a power stroke. When the gas in the sealed chamber is cooled, the pressure decreases and is acted upon by the piston thereby generating a return stroke.

Stirling Engines, however, require an external heat source to operate. The heat source may be the result of combustion and may also be solar or nuclear. In practicality, the rate of heat transfer to the working fluid within the Stirling Engine is one primary mechanism for increasing the power output of the Stirling Engine. One skilled in the art, however, will recognize that power output may be increased through a more efficient cooling process as well.

U.S. Pat. No. 5,590,526 to Cho describes a conventional prior art burner for a Stirling Engine. Generally, a combustion chamber provides an air-fuel mixture for the burner by mixing air and fuel supplied from air inlet passageways and a fuel injection nozzle, respectively. An igniter produces a flame by igniting the air-fuel mixture formed within the combustion chamber. A heater tube absorbs high temperature heat generated by the combustion of the air-fuel mixture and transfers the heat to the Stirling Engine working fluid. Exhaust gas passageways discharge an exhaust gas.

A more efficient heat source is described in U.S. Pat. No. 5,918,463 to Penswick, et al. (hereinafter referred to as "Penswick") in order to overcome the problem of delivering heat at non-uniform temperatures. As described by Penswick, Stirling engines require the delivery of concentrated thermal energy at uniform temperature to the engine working fluid. (See Penswick Column 1, lines 39-40). In the approach disclosed by Penswick, a burner assembly transfers heat to a Stirling Engine heater head primarily by radiation and secondarily by convection. (See Penswick Column 1, lines 58-61). Penswick discloses the device with respect to an external combustion engine, a Stirling Engine, and a Stirling Engine power generator. (See Penswick Column 2, lines 36-66.)

With respect to the external combustion engine, the Penswick burner assembly includes a housing having a cavity sized to receive a heater head and a matrix burner element carried by the housing and configured to transfer heat to the heater head. (See Penswick Column 2, lines 38-41). With respect to the Stirling Engine, the Penswick burner assembly includes a housing having a cavity sized to receive a heater head and a matrix burner element configured to encircle the heater head in spaced apart relation. (See Penswick Column 2, lines 48-51). Lastly, with respect to the Stirling Engine power generator, the Penswick burner assembly includes a housing having a cavity sized to receive the heater head and a matrix burner element configured to encircle the heater head in spaced apart relation. (See Penswick Column 2, lines 63-66).

The Penswick burner housing supports a fiber matrix burner element in radially spaced apart, but close proximity to, a radially outer surface of the Stirling Engine heater head. (See Penswick Column 4, lines 19-21). Penswick further discloses that combustion may occur in radiant or blue flame. In the radiant mode, combustion occurs inside matrix burner element which, in turn, releases a major portion of the energy as thermal radiation. In the blue flame mode, blue flames hover above the surface and release the major part of the energy in a convective manner. (See Penswick Column 4, lines 42-54). Hence, operation of the Penswick burner requires space between the combusting matrix element and the heater head in order to operate in any of the modes disclosed by Penswick.

Moreover, Penswick describes a heat chamber that is formed within the burner housing between the inner surface of the matrix burner element and the outer surface of the Stirling Engine heater head. Heat transfer occurs within the heat chamber primarily through radiation from the matrix burner element to the Stirling Engine heater head, and secondarily via the passing of hot exhaust gases over the Stirling Engine heater head. (See Penswick Column 6, lines 1-7, and FIG. 5). According to Penswick, heat being delivered through the heat chamber and over the Stirling Engine heater head is conserved as a result of insulation. (See Penswick Column 7, lines 17-20). However, a problem still exists in the art with respect to enhancing the efficiency of the operation of a Stirling Engine.

As recognized by one skilled in the art, the uniform burning of a matrix burner element remains a problem. In U.S. Pat. No. 6,183,241 to Bohn, et al. (hereinafter referred to as "Bohn"), computer simulation was employed to develop an inward-burning, radial matrix gas burner to attempt to solve the difficulty of obtaining uniform flow and uniform distribution in a burner matrix. (See Bohn, Abstract and Column 1, lines 54-56). According to Bohn, metal matrix burners have received much attention because of their ability to burn fossil fuels with very low emissions of nitrogen oxides. (See Bohn, Column 1, lines 37-39). With respect to the transfer of heat to the Stirling Engine heater head, Bohn also teaches that a significant fraction of the heat of combustion is released as infrared radiation from the matrix. (See Bohn, Column 1, lines 42-44).

Bohn's solution provides a high-temperature uniform heat via a cylinder-shaped radial burner, a curved plenum, porous mesh, divider vanes, and multiple inlet ports. Extended upstream fuel/air mixing point provide for uniform distribution of a preheated fuel/air mixture. (See Bohn, Column 4, lines 56-61). Bohn teaches the use of a space formed between a heat pipe and the burner matrix and the use of a mesh screen therebetween to promote uniform radiant heat transfer. Unfortunately, the solution offered by Bohn still is too complex and inefficient for desired uses.

Yet another method for transferring heat to the heater head of a Stirling Engine is disclosed in U.S. Pat. No. 6,877,315 to Clark, et al. (hereinafter referred to as "Clark"). According to Clark, the Stirling Engine heater head is generally arranged vertically with a burner surrounding it to supply heat so that hot exhaust gases from the burner can escape upwards. The device disclosed by Clark enhances the transfer of heat to the Stirling Engine heater head to increase its efficiency by employing fins to increase the heater head surface area. (See Clark, Column 1, lines 19-33). Clark teaches that a problem still exists in the art with respect to the effective and efficient transfer of heat to a Stirling Engine heater head as late as 2003.

In the device disclosed by Clark, an annular burner surrounds the heat transfer head and provides the heat source. The heat transfer head is provided with a plurality of fins to promote and enhance heat transfer. (See Clark, FIG. 1 and Column 2, lines 34-45). Radiant heat is transferred to the heater head and also to other substantially parallel fins to further enhance the heat transfer. (See Clark, Column 1, lines 63-65). As with the other prior art cited, the relative spaced-apart relationship that allows heat to be transferred radiantly is important. Clark teaches that the source of radiant heat is arranged opposite to the plurality of fins such that radiant heat is directed into the spaces between adjacent fins. (See Clark, Column 3, lines 4-6).

Another problem with burner devices for a Stirling Engine is described in U.S. Pat. No. 6,513,326 to Maceda, et al. (hereinafter referred to as "Maceda"). Maceda discloses a conventional burner device in which air and fuel are injected into the burner and then ignited to cause heat to be generated. The working gas is carried within a plurality of heater tubes that are positioned proximate to the burner device so that heat is transferred from the burner device to the working gas flowing within the heater tubes. (See Maceda, Column 1, lines 39-46). As known to one skilled in the art, the heater tubes are positioned proximate to the burner device such that heat can be radiantly transferred from the burner device to the tubes.

According to Maceda, heat is not uniformly distributed to the working gas within the heater tubes because a single burner device is used to generate and effectuate the heat transfer. (See Maceda, Column 1, lines 55-59). As a solution to the problem of uniform heat distribution, Maceda teaches the use of a heat exchange manifold employing multiple platelets that are stacked and joined together. (See Maceda, Column 2, lines 22-24). Instead of having one large burner device with one combustion chamber and a multiple of heater tubes per piston cylinder, the Maceda manifold provides a substantially greater number of individual combustion chambers. (See Maceda, Column 2, lines 51-57). Unfortunately, the solution offered by Maceda still is too complex and inefficient for desired uses.

Yet another apparatus and heat transfer method, similar to those of Cho and Maceda, are taught in U.S. Pat. No. 6,857,260 B2 (hereinafter "Langenfeld"). Langenfeld's apparatus comprises a heater head having attached thereto a plurality of heater tubes containing a working fluid. Langenfeld teaches that exhaust gases from a flame combustion are diverted past the heater tubes such that heat is transferred from the gases to the heater tubes, then from the heater tubes to the working fluid of the engine. The Langenfeld apparatus and method suffer from the same inefficient transfer of heat (via gas convection and flame radiation) as found in the previously described art.

Catalytic reactors are also known as disclosed, for example, in U.S. Pat. No. 4,965,052 (hereinafter "Lowther"), which teaches an integrated engine-reactor consisting of a first cylinder having a reciprocating piston, a second chamber filled with a catalytic material and in fluid communication with the first cylinder, and a third chamber in fluid communication with the second chamber. A chemical reaction is conducted in the first chamber and catalytically driven further in the second chamber; while the third chamber is adapted to receive combustion products from the first and second chambers. The disclosed catalyst is in the form of particulate solids, such as copper-zinc oxide or zeolites. Since the disclosed apparatus employs a working fluid in direct contact with all three chambers, the disclosure does not specifically relate to an apparatus for transferring heat to the acceptor head of an external combustion engine.

Based on the foregoing, what is needed are a simple, efficient and effective apparatus and method for generating heat and transferring the heat to the heater head of an external combustion engine, preferably, a Stirling Engine. A related apparatus for generating heat and transferring the heat to the heater head of a Stirling Engine is currently being prosecuted under Applicants' U.S. patent application Ser. No. 11/803,464, filed May 14, 2007.

SUMMARY OF THE INVENTION

In one aspect, the present invention provides a simple, efficient and effective catalytic reactor apparatus for generating heat and transferring the heat via conduction to the heater head of an external combustion engine, preferably, a Stirling Engine. The apparatus comprises:

(a) a combustor into which is internally secured a heater head of an external combustion engine, the combustor comprising a combustion chamber for mixing a fuel and an oxidant;
(b) a first inlet means for feeding a fuel into the combustion chamber;
(c) a second inlet means for feeding an oxidant into the combustion chamber;
(d) a combustion catalyst secured in direct contact with the heater head, the combustion catalyst comprising an ultra-short-channel-length metal substrate;
(e) an ignition means for lighting off the combustion catalyst and thus initiating flameless combustion of the fuel with the oxidant; and
(f) one or more outlet means for exhausting combustion gases.

In another aspect, this invention comprises an external combustion engine having a piston undergoing reciprocating linear motion within an expansion cylinder containing a working fluid heated through a heater head, wherein the improvement comprises employing a catalytic reactor for generating heat and transferring the heat of combustion via conduction to the heater head, the catalytic reactor comprising:

(a) a combustor into which is internally secured a heater head of the external combustion engine, the combustor comprising a combustion chamber for mixing a fuel and oxidant;
(b) a first inlet means for feeding a fuel into the combustion chamber;
(c) a second inlet means for feeding an oxidant into the combustion chamber;
(d) a combustion catalyst secured in direct contact with the heater head, the combustion catalyst comprising an ultra-short-channel-length metal substrate;
(e) an ignition means for lighting off the combustion catalyst and thus initiating flameless combustion of the fuel with the oxidant; and
(f) one or more outlet means for exhausting combustion gases.

In yet another aspect, this invention provides for a method of generating heat and transferring heat via conduction to a heater head of an external combustion engine, the method comprising:

(1) providing a catalytic reactor comprising:
  (a) a combustor into which is internally secured a heater head of the external combustion engine, the combustor comprising a combustion chamber for mixing a fuel with an oxidant;
  (b) a first inlet means for feeding a fuel into the combustion chamber;
  (c) a second inlet means for feeding an oxidant into the combustion chamber;
  (d) a combustion catalyst secured in direct contact with the heater head, the combustion catalyst comprising an ultra-short-channel-length metal substrate;
  (e) an ignition means for lighting off the combustion catalyst and thus initiating combustion of the fuel with the oxidant; and
  (f) one or more outlet means for exhausting combustion gases;
(2) feeding a fuel through the first inlet means into the combustion chamber;
(3) feeding an oxidant through the second inlet means into the combustion chamber;
(4) in the combustion chamber, contacting the fuel and the oxidant with the combustion catalyst;
(5) lighting-off the combustion catalyst so as to initiate flameless combustion of the fuel with the oxidant thereby generating heat of combustion, the heat being transferred substantially conductively from the combustion catalyst to the heater head; and
(6) exhausting combustion gases through the one or more outlet means.

It has now been found that a catalytic reactor comprising catalyst deposited on ultra-short-channel-length metal elements (substrate), known in a preferred embodiment as Microlith® brand ultra-short-channel-length metal mesh catalyst, which is commercially available from Precision Combustion, Inc., located in North Haven, Conn., efficiently and effectively generates heat as a burner within the operative constraints for a Stirling Engine known within the art. More importantly and in contrast to the prior art, the catalytic reactor comprising said catalyst, more preferably comprising one or more noble metals deposited on Microlith® brand ultra-short-channel-length metal mesh elements, is positioned in the apparatus of this invention in direct communication (i.e., in direct contact with, that is, non spaced-apart relation) with the heater head thereby providing heat transfer by thermal conduction, the most efficient manner of heat transfer in Stirling Engine applications.

Microlith® brand ultra-short-channel-length metal mesh technology is a novel reactor engineering design concept comprising a series of ultra-short-channel-length, low thermal mass metal monoliths that replace the long channels of a conventional monolith. For the purposes of this invention, the term "ultra-short-channel-length" refers to channel lengths in a range from about 25 microns (μm) (0.001 inch) to about 500 μm (0.020 inch). In contrast, the term "long channels" relevant to the prior art refers to channel lengths greater than about 5 mm (0.20 inch). The Microlith® brand ultra-short-channel-length metal mesh substrate is described in U.S. Pat. No. 5,051,241, incorporated herein by reference.

The preferred Microlith® brand ultra-short-channel-length metal mesh design promotes the packing of more active area into a small volume, providing increased reactivity area for a given pressure drop. Whereas in a conventional honeycomb monolith having conventional long channels, a fully developed boundary layer is present over a considerable length of the device; in contrast, the ultra-short-channel-length characteristic of the Microlith® brand substrate avoids boundary layer buildup. Since heat and mass transfer coefficients depend on the boundary layer thickness, avoiding boundary layer buildup enhances transport properties. The advantages of employing Microlith® brand ultra-short-channel-length metal mesh as a substrate to control and limit the development of a boundary layer of a fluid passing therethrough is described in U.S. patent application Ser. No. 10/832,055 which is a Continuation-In-Part of U.S. Pat. No. 6,746,657 to Castaldi, both incorporated in their entirety herein.

In one embodiment of the present invention (FIG. 6), a catalytic reactor (18) comprising a catalytically reactive Microlith® brand ultra-short-channel-length metal mesh is positioned in direct contact with heat exchanger fins (64) brazed onto the heater head (20). In this embodiment, the heat exchanger fins form an integral part of the heater head; and thus the metal mesh is in contact with (i.e., not spaced-apart from) thermally conductive walls of said heater head. Use of the catalytically reactive Microlith® brand ultra-short-channel-length metal mesh in this manner provides for: rapid catalytic light-off; excellent robustness for different fueling rates; and easy replacement of the catalytic reactor burner section of the Stirling Engine.

The thermally conductive walls of the catalytic reactor minimize the potential for overheating of the catalyst even at equivalence ratios near 1.0, where the term "equivalence ratio" is defined as the ratio of the actual mole ratio of fuel to oxidant combusted relative to the stoichiometric mole ratio of the fuel to oxidant for the combustion reaction (i.e., the mole ratio of fuel to oxidant for complete conversion of the fuel to $CO_2$ and $H_2O$). Energy, in the form of heat, is rapidly extracted from the catalytic fuel oxidation zone predominantly via thermal conduction from the catalyst to the heater head. Heat transfer via convection of combustion gases and radiation from the heated catalyst may also contribute to overall heat transfer.

Any conventional air supply, fuel supply, and air/fuel mixing technique may be employed to provide these feeds to the apparatus according to the present invention. Any conventional mounting technique may be employed to mount the apparatus according to the present invention directly to and with thermal conductivity to the heater head of the Stirling Engine.

In further contrast to the prior art, the present invention comprises a flameless combustion zone. As those skilled in the art know, combustion comprising a flame must address high flame temperature conditions and provide flame-holding techniques. Flameless combustion avoids these problems associated with flame burners. As with all fuel-consuming systems, auto-ignition also must be addressed.

In another embodiment of the present invention, the catalytic burner employs an electrohydrodynamic liquid fuel dispersion system, generally referred to as an electrosprayer, as described in significant detail in U.S. Patent Application Publication 2004/0209205 (U.S. patent application Ser. No. 10/401,226) in the names of Gomez and Roychoudhury; filed on Mar. 27, 2003, and claiming priority to U.S. Provisional Patent Application No. 60/368,120.

In another embodiment of the present invention, the Stirling Engine burner apparatus comprises a recuperator, fuel injector, mixer (via swirler), heat transfer arrangement and igniter for catalyst ignition (e.g., via resistive heating).

BRIEF DESCRIPTION OF THE DRAWINGS

FIG. 1 provides a top view of a Stirling Engine heater head surrounded by a catalyst bed and catalyst holder in accordance with the present invention.

FIG. 2 provides a side view cut-away along Line A-A of the Stirling Engine heater head depicted in FIG. 1.

DETAILED DESCRIPTION OF THE INVENTION

Figure 3:
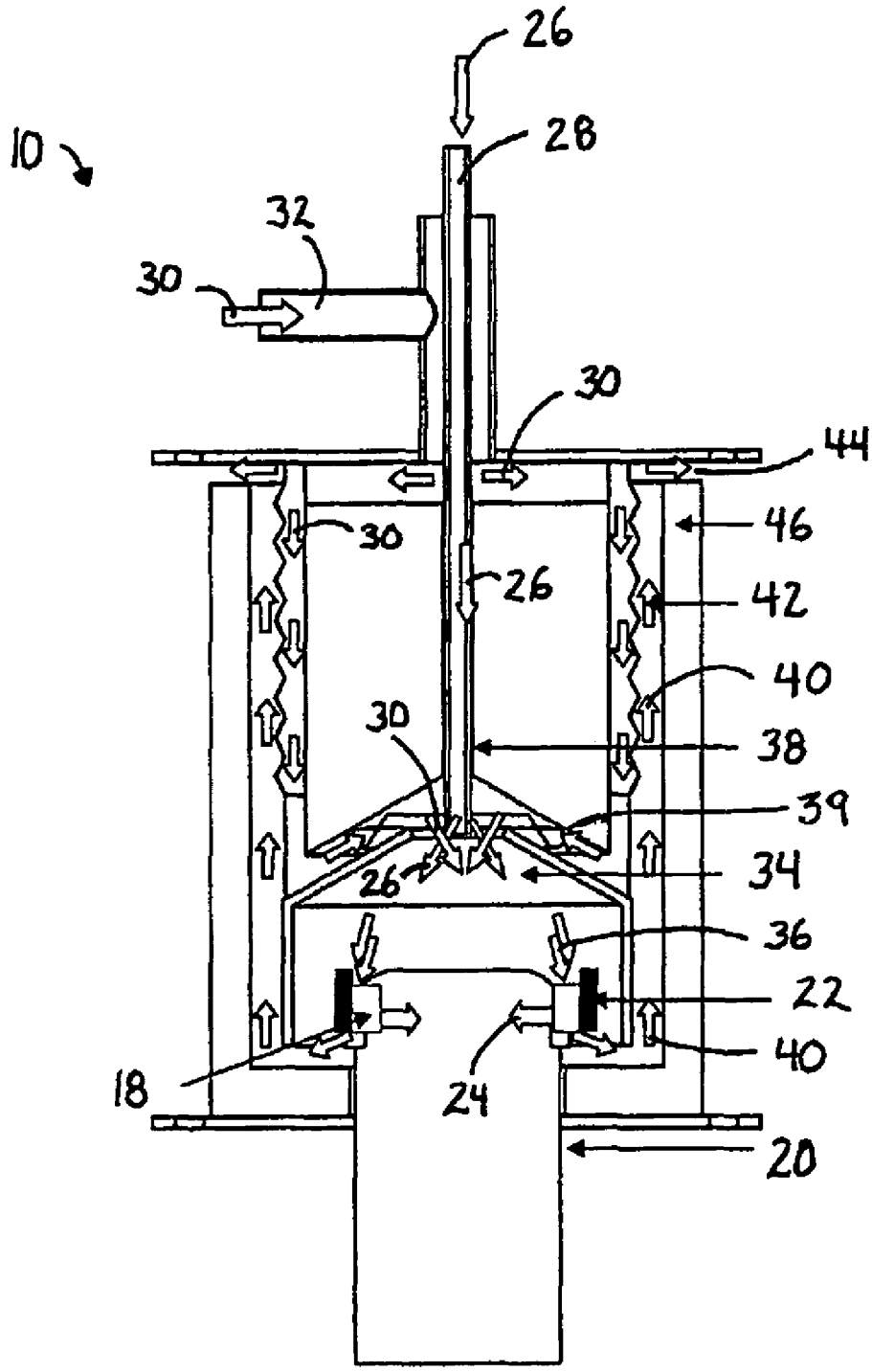
FIG. 3 provides a schematic cut-away of an external combustion engine employing a Stirling Engine heater head in turn employing a heat source according to the present invention.

In a preferred aspect, the present invention provides a simple, efficient and effective catalytic reactor apparatus for generating heat and transferring the heat via conduction to the heater head of an external combustion engine. The apparatus comprises:

(a) a combustor into which is internally secured a heater head of an external combustion engine, the combustor comprising a chamber for mixing fuel and air;
(b) a fuel injection path for feeding a liquid fuel into the chamber;
(c) an air injection path for feeding air into the chamber;
(d) a catalytic reactor in direct contact with the heater head, the catalytic reactor comprising a catalyst deposited on ultra-short-length-channel metal elements;
(e) an igniter for lighting off the catalyst and thus initiating flameless combustion of the fuel with air; and
(f) an outlet port for exhausting combustion gases.

In another preferred aspect, this invention comprises an external combustion engine having a piston undergoing reciprocating linear motion within an expansion cylinder containing a working fluid, wherein the improvement comprises employing a catalytic reactor for generating heat and transferring the heat of combustion via conduction to the heater head, the catalytic reactor comprising:

(a) a combustor into which is internally secured a heater head of the external combustion engine, the combustor comprising a combustion chamber for mixing a fuel with air;
(b) a fuel injection path for feeding a fuel into the combustion chamber;
(c) an air injection path for feeding air into the combustion chamber;
(d) a combustion catalyst secured in direct contact with the heater head, the combustion catalyst comprising an ultra-short-channel-length metal substrate;
(e) an ignition means for lighting off the combustion catalyst and thus initiating flameless combustion of the fuel with the air; and
(f) one or more outlet ports for exhausting combustion gases.

In yet another preferred aspect, this invention provides for a method of generating heat and transferring the heat via conduction to a heater head of an external combustion engine, the method comprising:

(1) providing a catalytic reactor comprising:
  (a) a combustor into which is internally secured a heater head of the external combustion engine, the combustor comprising a combustion chamber for mixing a fuel with air;
  (b) a fuel injection path for feeding a fuel into the combustion chamber;
  (c) an air injection path for feeding air into the combustion chamber;
  (d) a combustion catalyst secured in direct contact with the heater head, the combustion catalyst comprising an ultra-short-channel-length metal substrate;
  (e) an ignition for lighting off the combustion catalyst and thus initiating flameless combustion of the fuel with the oxidant; and
  (f) one or more outlet ports for exhausting combustion gases;
(2) feeding a fuel through the fuel injection path into the combustion chamber;
(3) feeding air through the air injection path into the combustion chamber;
(4) in the combustion chamber, contacting the fuel and air with the combustion catalyst;
(5) lighting-off the combustion catalyst and thus initiating flameless combustion of the fuel with the air thereby generating heat of combustion, the heat being transferred substantially conductively from the combustion catalyst to the heater head; and
(6) exhausting combustion gases through the one or more outlet ports.

As shown in FIGS. 1 and 2 (and generally referred to as system 10 in FIG. 3) catalytic reactor 12 (see part 18 in FIG. 3) is positioned in direct contact, that is, in non-spaced apart relation with (i.e. direct communication with) heater head 14, and rigidly held in place by catalyst holder 16. Catalytic reactor 12 comprises catalyst, preferably, one or more noble metals, deposited on an ultra-short-channel-length metal element or plurality of elements (substrate), preferably, Microlith® brand ultra-short-channel-length metal mesh elements or substrate. The reactor provides heat transfer to heater head 14 substantially by thermal conduction, which means that advantageously greater than about 60 percent, and preferably, greater than about 70 percent of combustion heat is conductively transferred from the catalytic reactor 12 to the heater head 14. Catalyst holder 16 also serves as a heat exchanger with respect to the heat generated by the catalytic reactor 12 and transferred to the gases passing over and in proximity to catalyst holder 16.

In an embodiment of the invention as depicted in FIG. 3, system 10 comprises a catalytic reactor 18 positioned in direct contact communication (i.e., non-spaced apart relation) with Stirling Engine heater head 20, and held in place by catalyst holder 22. Catalytic reactor 18 provides heat transfer to heater head 20 by thermal conduction 24 through internal heat acceptor 20. In the embodiment of the invention depicted, fuel 26 is introduced via fuel injection path 28 and the preferred oxidant air 30 is introduced via air injection path 32. Fuel 26 and air 30 are mixed in region 34 providing fuel/air mixture 36.

The mixing of fuel 26 and air 30 is advantageously enhanced by incorporating an electrospray nozzle 38 and swirler 39 within fuel injection path 28 such as the method for electrospraying fuels disclosed in U.S. patent application Ser. No. 10/401,226; filed on Mar. 27, 2003, and claiming priority to U.S. Provisional Patent Application No. 60/368,120; which description of such electrospray method is incorporated herein by reference. Catalytic combustion reactants 40 exit catalytic reactor 18 and flow through recuperator 42 until they exit the system at exhaust port 44. Recuperator 42 may be surrounded by insulation layer 46.

The catalytic reactor 18 of the embodiment described above with reference to FIG. 3 comprises the preferred catalytically reactive Microlith® brand ultra-short-channel-length metal mesh positioned, more preferably, in direct contact with heat exchanger fins that are brazed onto the heat acceptor head and form an integral part thereof. In such embodiment, the metal mesh is considered to be not spaced-apart from the thermally conductive walls of the heater head. Catalytic reactor 18 further comprises at least one catalyst known in the art for fuel oxidation such as, for example, platinum or palladium on alumina.

Fuel 26 comprises any conventional gas or liquid hydrocarbon fuel, for example, methane, ethane, propane, butane, kerosene, aromatics, paraffins, or mixture thereof; preferably, a liquid hydrocarbon fuel, more preferably, Jet Propulsion 8 fuel (hereinafter "JP-8 fuel") known in the art; and the air/fuel mixing method comprises a method for electrospraying fuels as disclosed in U.S. patent application Ser. No. 10/401,226.

Figure 9:
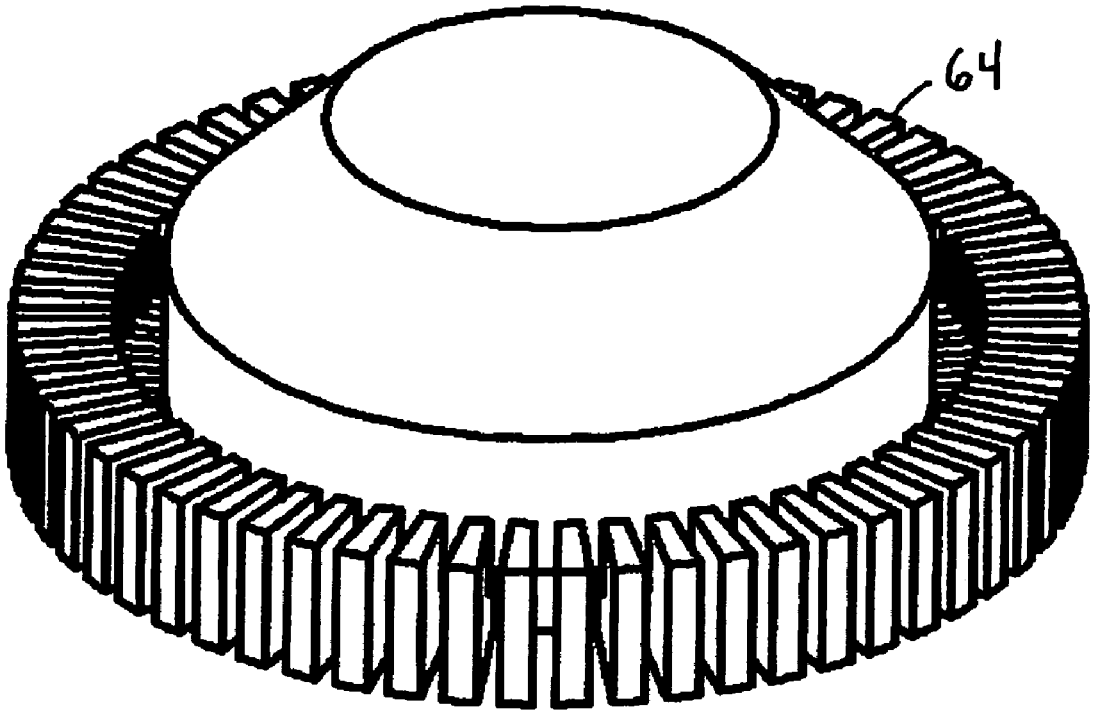
FIG. 9 provides an isometric view of a heat exchanger configuration in accordance with the present invention.

Catalyst holder 22, securing the catalytic reactor 18 to the heater head, can be any appropriately machined part made of conventional material, such as stainless steel, and may have a flat surface or a finned or corrugated shape, as seen in FIG. 3 or 9, respectively. Recuperator 42 provides heat transfer from catalytic combustion reactants 40 exiting catalytic reactor 18 and flowing through recuperator 42 to air 30 flowing through air injection path 32.

The liquid fuel is injected, vaporized, mixed with air and ultimately oxidized catalytically. As an alternative embodiment, if the fuel is a gas, for example, methane or propane, then the fuel inlet path and the oxidant inlet path may be coincidental, such that a mixture of fuel and oxidant is fed through one inlet path into the combustion chamber.

Vaporization, mixing and recuperation are the primary contributors to the overall combustor dimensions. For the burner to be highly efficient, a recuperator is used to extract energy from the exhaust gases to preheat the inlet air. The energy released in the combustor is transferred substantially via conduction to the heater head of the external combustion engine, for example to a Free Piston Stirling Engine (FPSE), optionally, through an optimized heat exchange interface as described in detail hereinafter.

To minimize the volume of the mixing chamber preceding catalytic conversion of fuel into combustion products, a swirling means may be installed to provide a whirling flow field that introduces air with a tangential velocity component into the cylindrical chamber. This swirler shows markedly improved temperature uniformity on the catalytic surface, which is crucial for efficient coupling with a Stirling engine. Uniformity of temperature relates directly to the homogeneity of the local equivalence ratio, defined as the ratio of the actual mole ratio of fuel to oxidant combusted at any given local catalytic site relative to the stoichiometric mole ratio of the fuel to oxidant for the combustion reaction (i.e., the mole ratio of fuel to oxidant for complete combustion to $CO_2$ and $H_2O$).

In a preferred embodiment, a low pressure drop radial swirler is coaxially located with the fuel nozzle a few millimeters downstream of the atomizer. This preferred embodiment results in uniform mixing of the inlet air, including fresh and recuperated air, and the fuel droplets. The fuel is essentially fully vaporized and mixed with the oxidizer in the mixing chamber and directed towards the catalyst.

Advantageously, the catalytic reactor discussed has a cylindrical configuration. The use of thin and flexible Microlith® brand ultra-short-channel-length metal mesh elements makes the conformation to specific geometric requirements relatively easy. In particular, since the hot end of the FPSE is a cylindrical strip, the catalytic reactor can be cylindrically shaped by placing or wrapping the Microlith® catalytic grid around the acceptor zone of the FPSE and flowing the air-fuel mixture through the grid. The average residence time across the catalytic reactor is estimated at 0.8 milliseconds (ms), which, as expected, is much smaller than the estimated evaporative and mixing time. The prevailing Peclet number, which controls the necessary packing density to achieve complete fuel conversion, is estimated at 30, which may require the stacking of several layers to achieve fuel oxidation to a conversion greater than about 90 percent. Thus, the metal mesh may be used in one layer, if desired; but, stacking a plurality of layers from about 2 to about 20 layers, is preferred. Since durability tests show that the catalyst performance does not deteriorate significantly over a period of about 500 hrs, it is anticipated that periodic maintenance of the energy converter will require catalyst replacements at intervals on the order of about 1000 hrs.

The exhaust gas is muted through a recuperator comprising a counterflow heat exchanger consisting of a corrugated metal lamina separating the exhaust from the incoming air, while allowing for heat transfer between the two gases. The recuperator occupies a cylindrical jacket wrapping the burner. This geometric configuration is also chosen to avoid preheating the fuel line because of the fouling risk associated with the use of JP-8 fuel. Temperature measurements via K-type thermocouples at the inlet and outlet of the recuperator yielded an estimated heat recovery effectiveness of 85 percent of the exhaust gas heat. In addition to boosting the overall thermal efficiency of the combustor, the recuperator has the important function of reducing the droplet evaporation time by elevating the average temperature in the combustor to about 1000 K, thereby increasing the evaporation coefficient several folds. The exhaust gas temperature, typically at or about 450 K, is further decreased by mixing the exhaust gas with engine cooling air at or about 325 K, to lower the system thermal signature.

The Balance of Plant (BOP) consists of an air blower, fuel pump, igniter, instrumentation and controls. The challenge is to identify lightweight, compact, low power draw components. In order to minimize the air blower parasitic draw, a low pressure drop recuperator and flow path are designed comprising a controllable, low flow, JP-8 tolerant, inexpensive liquid fuel pump. A resistively heated element, analogous to a glow plug, is used to light off the catalyst, in the presence of fuel and air, at ambient conditions (taken as 22° C. and 1 atmosphere pressure). An onboard rechargeable battery (minimal size necessary) is used to energize the igniter, pumps and blowers. The total burner parasitic load consisting of the air blower, fuel pump, electrospray (ES) energizer was advantageously less than about 1 Watt electric (We) for a 40 We system (or $1/40^{th}$ of the gross). A control-logic for startup, shutdown and load change is advantageously identified and implemented via PID controllers in a manner known to one skilled in the art.

Advantageously, the catalytic reactor operates at an equivalence ratio ranging from about 0.2 to about 1.0. Flow rates, temperature and pressure in the catalytic combustor are conventional and known in the art. Once catalytic combustion is initiated with the igniter, the combustion is flameless and self-sustaining.

In a specific embodiment of the invention, a catalytic reactor for transferring heat to the heater head of a Stirling Engine was constructed as shown in FIGS. 1, 2, and 3 and as described hereinabove. The volume of the catalytic combustor/recuperator was 0.4 L, operating with JP-8 fuel at a fuel rate on the order of tens of g/hr and an equivalence ratio between 0.35 and 0.70. Under full load conditions the average catalyst temperature over multiple runs was 1002 K and the average FPSE head temperature was 923 K. With these values, one can estimate the dominant heat transfer method between the catalytic reactor and the engine heater head.

Figure 6:
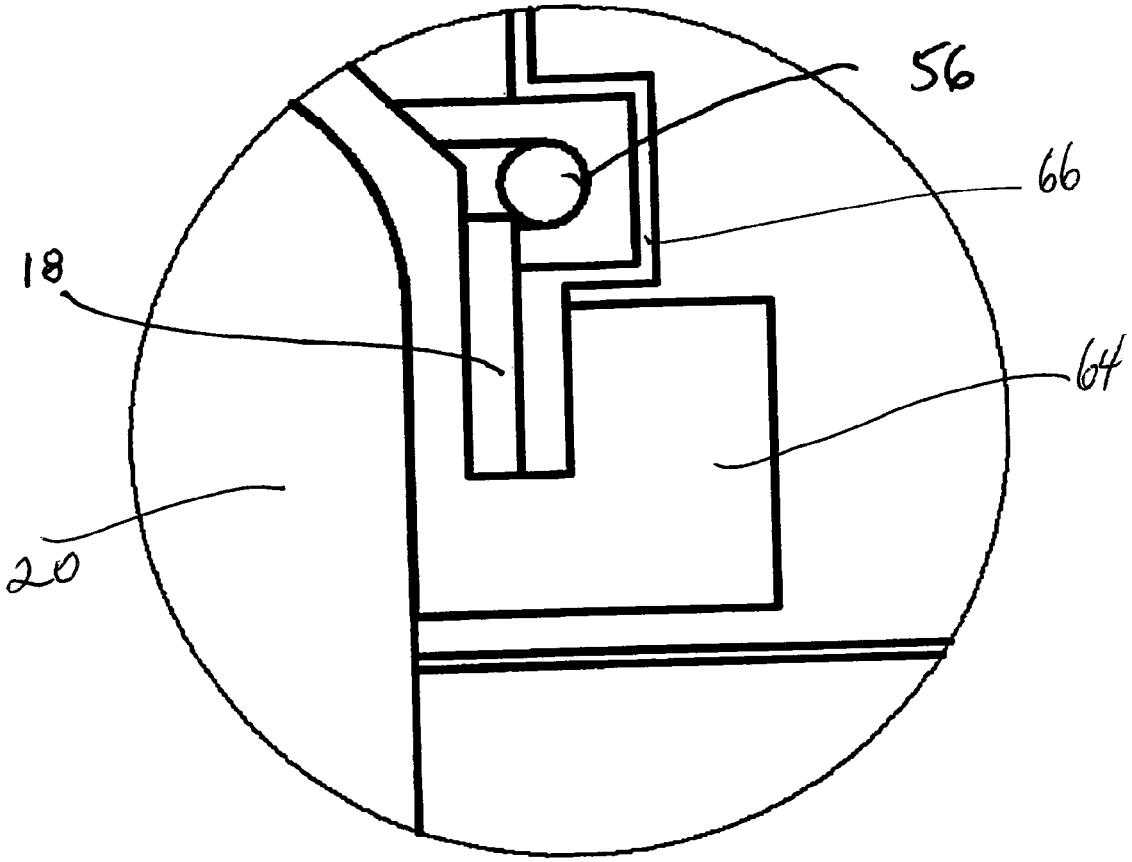
FIG. 6 provides a schematic cut-away of an external combustion engine employing a Stirling Engine heater head in turn employing an ignition source according to the present invention.

In an alternative embodiment, to increase the heat transfer between the catalytic reactor and the heater head, a heat exchanger consisting of a finned cylinder (FIGS. 6 and 9, part 64) was brazed onto the engine head (FIG. 6(20)) and as also seen in FIG. 9. In this embodiment, the heat exchanger became an integral part of the heater head, and the catalyst was placed in conductive contact with the engine head. The catalyst was fitted into a groove in the heat exchanger, as seen in FIG. 6 (18) and FIG. 9. Thermocouple measurements in the catalyst bed and at the exit of the heat exchanger fins suggested that convective and radiative heat recovery from the fins was less than 20 percent. Consequently, in both embodiments conduction was the primary means of thermal input into the engine as confirmed by estimates based on the interface geometry and an average thermal conductivity for the construction material of the heater head and fins, specifically in these embodiments Nickel 201, over the temperature range under consideration.

Figure 10:
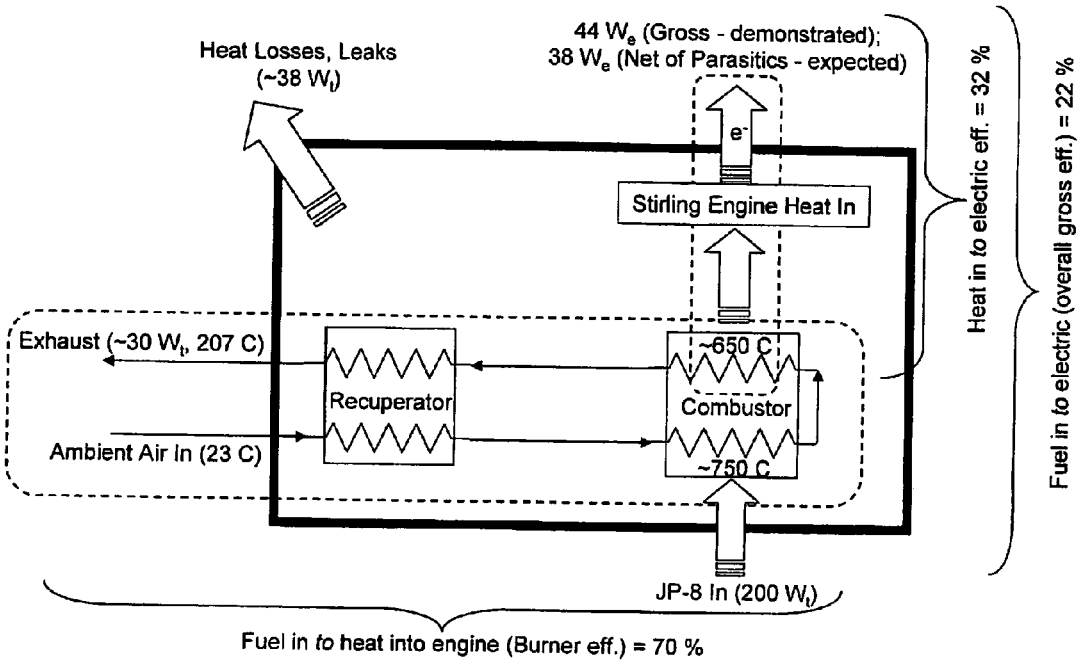
FIG. 10 provides an efficiency flow chart representing the operation of an embodiment of the present invention.

FIG. 10 depicts an energy efficiency flow chart for an embodiment of the invention wherein a combustor of this invention was placed in direct contact with a Stirling heat acceptor head for conversion of heat energy into electrical energy. More specifically, FIG. 10 depicts an efficiency flow chart representing the burner, recuperator, and an FPSE heat acceptor along with the losses observed due to leaks and ineffective insulation. "Burner efficiency" can be defined as the ratio of the thermal power input to engine over the chemical power associated with the mass flow rate of a fuel of a prescribed heating value.

For an input of 200 Wt JP-8 fuel energy, the overall conversion efficiency of fuel (chemical energy to heat) was calculated as 70 percent; the overall conversion efficiency of fuel (chemical energy) to electrical energy was 22 percent (gross). Net of parasitic was approximately 20 percent. The balance of the 200 Wt input as chemical energy was split into 30 Watt thermal (Wt) associated with the exhaust gases at 450 K after recuperation, and 38 Wt of various other losses associated with imperfect insulation of the structure, as depicted in FIG. 10. Note that the heat transfer efficiency from the fuel to the head was compromised due to heat losses, e.g. flanges and thick walled chambers acting as heat sinks in the test setup, radiative and convective losses to the exhaust, and limited insulation. Once optimized, the heat transfer efficiency is likely to improve the overall fuel to electric efficiency. Remarkably, even though JP-8 is notoriously problematic, with attendant coking and sooting tendencies, the burner operated cleanly with no noticeable traces of deposits.

The burner design also was scaled up for a 160 We propane fueled battery charger unit and its performance demonstrated.

The present invention demonstrates the development of a compact, lightweight, efficient recuperated JP-8 burner to provide the heat source for Stirling engines. Optimal catalyst, swirler, electrospray, igniter and recuperator designs were implemented. The burner was integrated with a FPSE and problems due to soot or coke deposit were avoided. A small pump and blower was identified and implemented with net parasitic loads of less than 1 We for the 40 We system. A simple burner control logic was identified and implemented for operational flexibility. Results with a brassboard unit showed high gross fuel-electric efficiency of 22% (20% net of parasitics) at extremely low acoustic and thermal signatures. This data indicated an energy density on the order of 1,000 W-hr/kg (3.6 MJ/kg). These data are significantly better than that found for larger commercially available generator sets, which range between 5-12% fuel to electric efficiency. Burner scalability and multi-fuel operation (with H2, Propane, Propylene, etc.) was demonstrated in a parallel 160 We battery charger unit.

Figure 4:
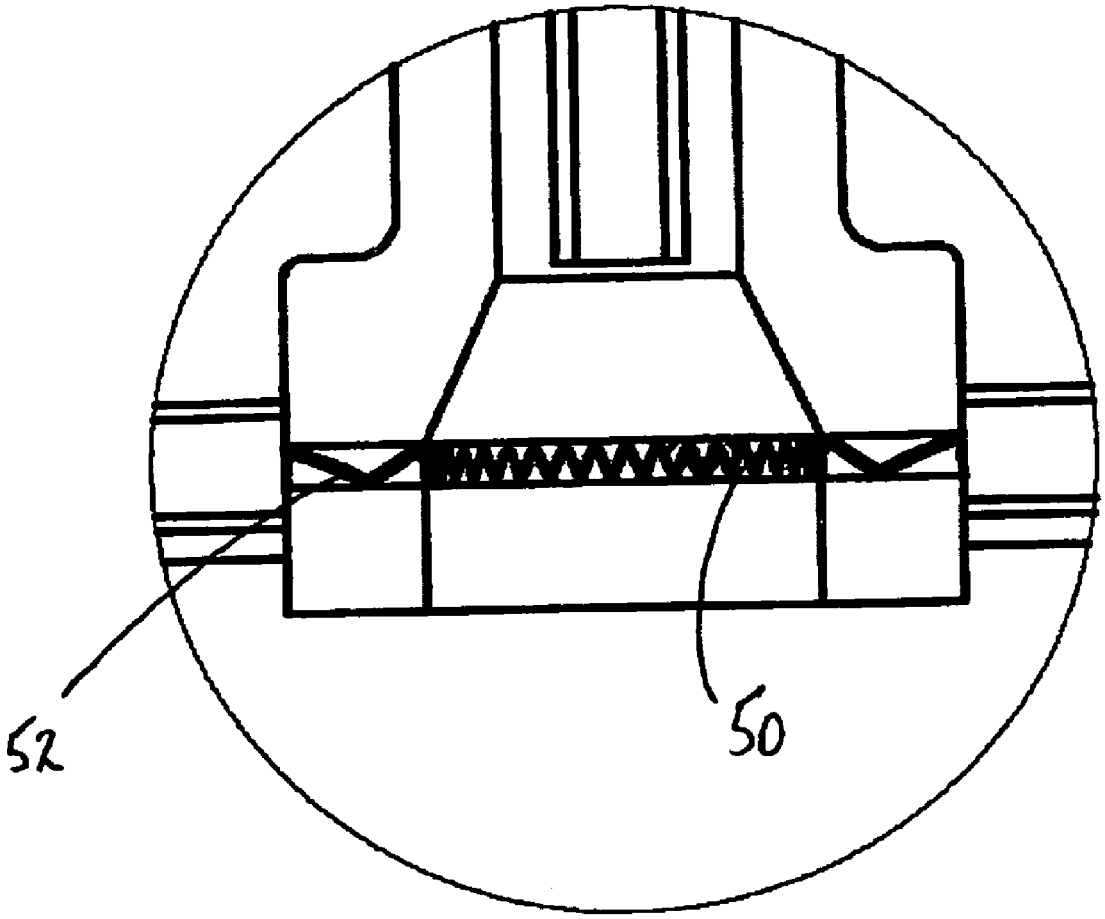
FIG. 4 provides a schematic cut-away view of a grounded swirler in accordance with the present invention.
Figure 5:
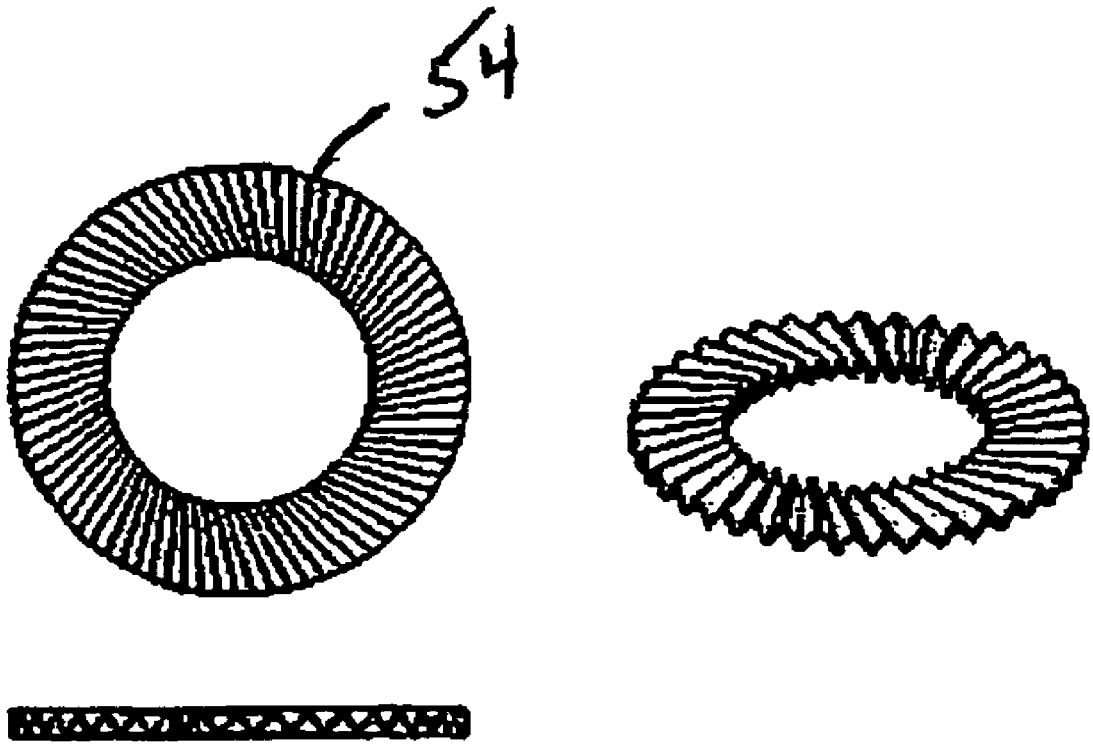
FIG. 5 provides top, side and isometric views of a swirler in accordance with the present invention.

In the embodiment of the invention using JP-8 fuel, described hereinabove, the electrospray approach provided electrical isolation and a ground terminal. As shown in FIG. 4, the swirler 50 was used as the grounding source 52. The electrical isolation can thus be readily implemented. A novel swirler 54 as shown in FIG. 5 was used for low pressure drop and good mixing. The swirler was made of a Nickel-Chrome strip corrugated at a 30 degree angle and formed into a circular part inducing a 30 degree swirl to the incoming air.

With reference to FIG. 6, ignition of the fuel on the catalyst was implemented by a cable heater 56 wrapped in a circle concentric to the catalyst and adjacent to the outer corner of the catalyst substrate (18). The power provided to the 5.4" long 0.0625" D heater was 19V at 3 Amps. The radiation and conduction of this 57 Watts of heat permitted lighting off the catalyst with low electrical power while minimizing contact of the heater with the catalyst for maximum life and minimized power.

Figure 7:
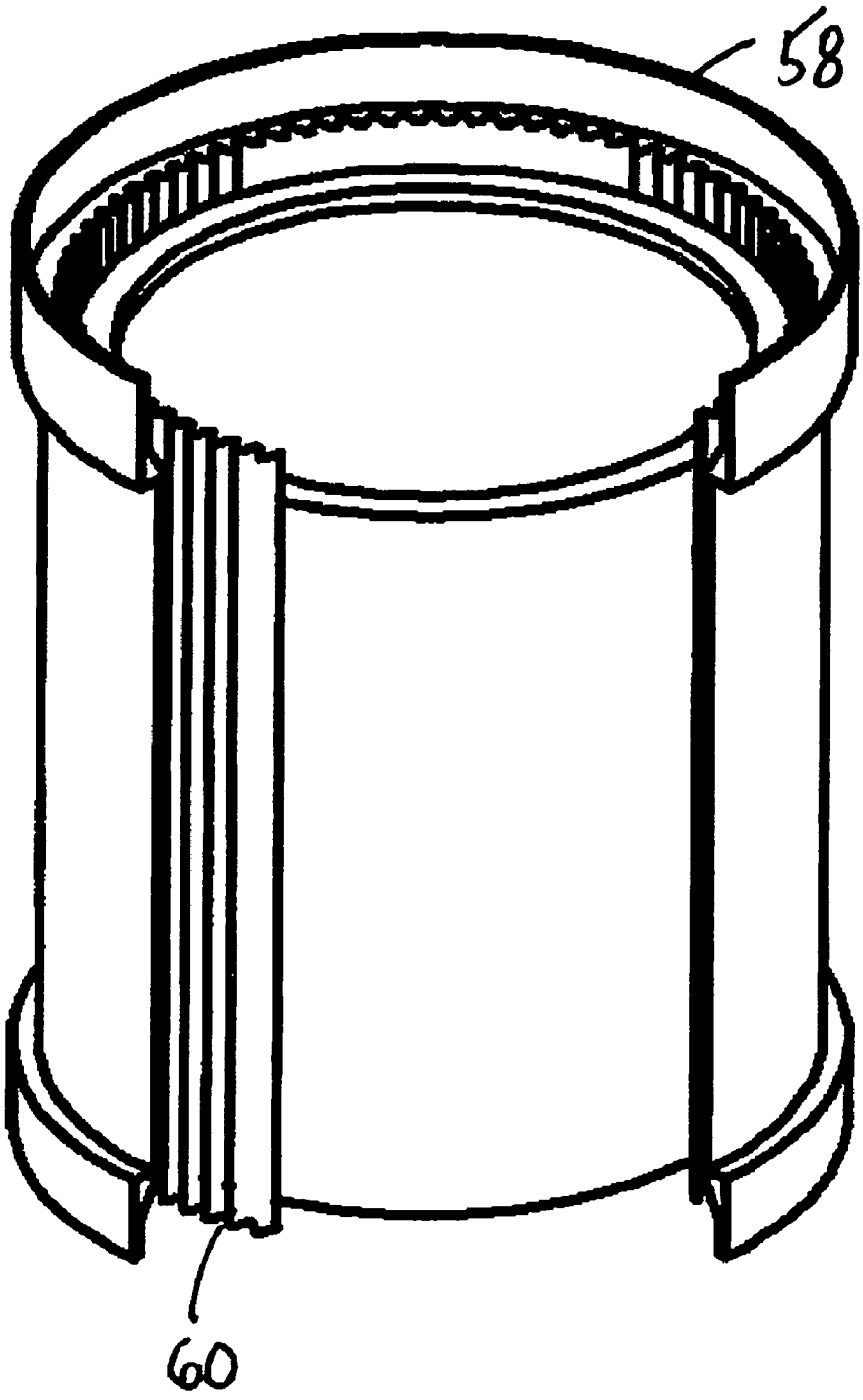
FIG. 7 provides an isometric view of a recuperator in accordance with the present invention.

As shown in FIG. 7, recuperator 58 is integrated with the burner such as to shield the hot zone (via an extension of the recuperator) and also to provide the external burner housing. Insulation is applied to this housing. The recuperator is advantageously constructed of corrugated stainless steel 60. This design provides the necessary heat transfer from catalyst to inlet air that would otherwise be lost, while also maintaining a low enough pressure drop to work with the system.

Figure 8:
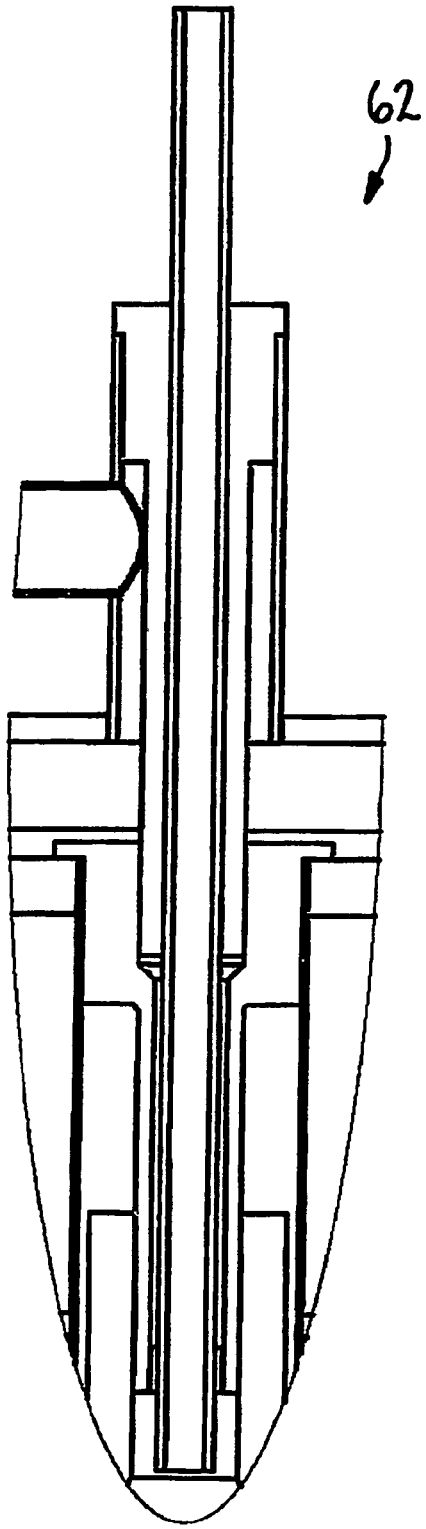
FIG. 8 provides a schematic cut-away view of a fuel nozzle in accordance with the present invention.

Fuel nozzle 62 depicted in FIG. 8 is located such as to use bypassed inlet combustion air for nozzle cooling (a critical requirement to prevent deposits within the nozzle and fuel boiling). Approximately five percent of the air into the burner is routed straight to the combustion area along the fuel nozzle, bypassing the recuperator to keep the temperature low. This prevents the fuel from heating to the point of creating coke/ fuel deposits and spontaneous boiling away from the tip, causing erratic operation. The fuel delivery system also permits inorganic contaminants to deposit on a collection plate as opposed to fouling up the catalyst. Inorganic components in the fuel do not vaporize; and due to the non collinear orientation of the nozzle to the catalyst, the inorganics drop straight down while the vaporized fuel/air carries on to the catalyst.

As shown in FIG. 6 and FIG. 9, heat exchange fins 64 are designed such as to hold the catalyst (FIG. 6(18)), maximize the heat transfer from the catalyst to the fins and appropriately overlap the acceptor region of the heater head (FIG. 6 (20)), more particularly, any acceptor fins internal to the engine, such as to maximize the heat transfer efficiency to the engine. Nickel fins are used for the maximum heat transfer coefficient at high temperature while maintaining corrosion resistance at 650° C. The geometry and location of the heat exchanger and catalyst pack are chosen to optimize conduction, convection and radiation of heat from the catalyst reaction into the engine heater head, with conduction being a focal point of this invention.

With reference to FIG. 6, a mounting design, whereby the burner is made easily removable/attachable from/to the engine for service purposes and for ease of manufacture, can also be employed. This design is based on two closely mated surfaces, forced together to optimize heat transfer between them, while also being removable with a minimum of time and tooling. The surface on the heat generation side fits down over the receiver side. The main housing of the burner snaps to the acceptor head by means of a snap ring with a ceramic paper seal. The engagement occurs at the outer-most edge of a thin plate welded to the acceptor head and the plate is insulated from the combustion exhaust to avoid excessive heat loss. The thin plate is crimped on the edge to provide rigidity for the sealing surface and a more obstructive leak path. Appropriate heat shielding to prevent overheating of the engine dome may be incorporated as well as burner assembly/clamping means to permit ease of assembly while preventing leaks. As seen in FIG. 6, contact of the heater cable (56) with the outer shell (66) must be limited in order to minimize heat transfer away from catalyst by conduction, and in order to maximize heater cable temp to maximize radiation.

While the present invention has been described in considerable detail, other configurations exhibiting the characteristics taught herein for improved heat generation and transfer to the heater head of a Stirling Engine by thermal conduction employing flameless combustion are contemplated. Therefore, the spirit and scope of the invention should not be limited to the description of the preferred embodiments described herein.

The invention claimed is:

1. A catalytic reactor apparatus for generating heat and transferring the heat via conduction to the heater head of an external combustion engine, comprising:

a) a combustor into which is internally secured a heater head of an external combustion engine, the combustor comprising a combustion chamber for mixing a fuel and an oxidant;

b) a first inlet means for feeding a fuel into the combustion chamber;

c) a second inlet means for feeding an oxidant into the combustion chamber;

d) a combustion catalyst secured in direct contact with the heater head, the combustion catalyst comprising an ultra-short-channel-length metal substrate;

e) an ignition means for lighting off the combustion catalyst and thus initiating flameless combustion of the fuel with the oxidant; and f) one or more outlet means for exhausting combustion gases.

2. The catalytic reactor apparatus of claim 1 further comprising a vaporizer for vaporizing the fuel prior to combustion.

3. The catalytic reactor apparatus of claim 1 further comprising a swirling means for mixing the fuel and oxidant prior to contact with the catalyst.

4. The catalytic reactor apparatus of claim 1 further comprising a recuperator comprising a corrugated heat conductive material separating the inlet means for feeding air from the outlet means for exhausting combustion gases.

5. The catalytic reactor apparatus of claim 1 further comprising a heat exchanger as an integral part of the heater head.

6. The catalytic reactor apparatus of claim 1 wherein the catalyst comprises one or more noble metals deposited upon the ultra-short-channel-length metal substrate.

7. An external combustion engine having a piston undergoing reciprocating linear motion within an expansion cylinder containing a working fluid, heated by conduction through a heater head, wherein the improvement comprises employing a catalytic reactor for generating heat and transferring the heat of combustion via conduction to the heater head, the catalytic reactor comprising:

a) a combustor into which is internally secured a heater head of the external combustion engine, the combustor comprising a combustion chamber for mixing a fuel with an oxidant;

b) a first inlet means for feeding a fuel into the combustion chamber;

c) a second inlet means for feeding an oxidant into the combustion chamber;

d) a combustion catalyst secured in direct contact with the heater head, the combustion catalyst comprising an ultra-short-channel-length metal substrate;

e) an ignition means for lighting off the combustion catalyst and thus initiating flameless combustion of the fuel with the oxidant; and f) one or more outlet means for exhausting combustion gases.

8. A method of generating heat and transferring the heat via conduction to a heater head of an external combustion engine, the method comprising:

1) providing a catalytic reactor comprising:

a) a combustor into which is internally secured a heater head of the external combustion engine, the combustor comprising a combustion chamber for mixing a fuel with an oxidant;

b) a first inlet means for feeding a fuel into the combustion chamber;

c) a second inlet means for feeding an oxidant into the combustion chamber;

d) a combustion catalyst secured in direct contact with the heater head, the combustion catalyst comprising an ultra-short-channel-length metal substrate;

e) an ignition means for lighting off the combustion catalyst and thus initiating flameless combustion of the fuel with the oxidant; and f) one or more outlet means for exhausting combustion gases;

2) feeding a fuel through the first inlet means into the combustion chamber;

3) feeding an oxidant through the second inlet means into the combustion chamber;

4) in the combustion chamber, contacting the fuel and oxidant with a combustion catalyst, the combustion catalyst comprising an ultra-short channel length metal substrate;

5) lighting-off the combustion catalyst and thus initiating flameless combustion of the fuel with the oxidant thereby generating heat of combustion, the heat being transferred substantially conductively from the combustion catalyst to the heater head; and 6) exhausting combustion gases through the one or more outlet means.

9. The method of claim 8 further wherein the fuel is atomized into droplets and vaporized prior to contact with the combustion catalyst.

10. The method of claim 8 wherein the fuel and oxidant are mixed by means of a swirler prior to contact with the combustion catalyst.

11. The method of claim 8 wherein the combustion gases are passed through a recuperator to extract heat from the gases, which heat is then employed to raise the temperature of the oxidant fed through the second inlet means.

12. The method of claim 8 further wherein a heat exchanger is further provided as an integral part of the heater head, and combustion gases leaving the reactor contact the heat exchanger for further recuperation of heat.

13. The method of claim 8 wherein the catalyst comprises one or more noble metals deposited on the ultra-short-channel-length metal substrate.

14. The method of claim 13 wherein the ultra-short-channel-length metal substrate is an ultra-short-channel-length metal mesh substrate.

15. The method of claim 8 wherein the oxidant is air and the fuel is JP-8 fuel.

* * * * *